US006332256B1

(12) United States Patent
Dawson

(10) Patent No.: US 6,332,256 B1
(45) Date of Patent: Dec. 25, 2001

(54) HOLDING DEVICE

(75) Inventor: Malcolm Bruce Dawson, Solihull (GB)

(73) Assignee: Auto Service Tools Limited (GB)

( * ) Notice: Subject to any disclaimer, the term of this patent is extended or adjusted under 35 U.S.C. 154(b) by 0 days.

(21) Appl. No.: 09/709,952

(22) Filed: Nov. 10, 2000

(30) Foreign Application Priority Data

Aug. 18, 2000 (GB) ..... 0020306

(51) Int. Cl.[7] ..... B25B 27/14
(52) U.S. Cl. ..... 29/281.5; 29/271
(58) Field of Search ..... 474/101; 29/281.1, 29/281.5, 271, 888.011, 402.03, 402.08, 426.1, 464, 239; 188/2 R, 4 R, 74, 36; 269/37, 35, 82

(56) References Cited

U.S. PATENT DOCUMENTS 4,684,357 8/1987 Hooper .
5,490,582 * 2/1996 Trowbridge ..... 188/2 R
5,755,029 5/1998 Learned .
5,950,294 9/1999 Gibbs .
6,058,585 5/2000 Soleymani .

FOREIGN PATENT DOCUMENTS 2340539A 2/2000 (GB) .

* cited by examiner

*Primary Examiner*—Robert C. Watson
(74) *Attorney, Agent, or Firm*—MacMillan, Sobanski & Todd, LLC

(57) ABSTRACT

A device for holding a rotary element stationaly relative to another rotary element adjacent thereto, comprising a first holding member engageable with one of said rotary elements; a second holding member engageable with one of said rotaly elements; a third holding member engageable with one of said rotary elements; a fourth holding member engageable with one of said rotary elements; and structure connecting said holding members together and providing for adjustment of at least three of said holding members relatively to one another, and for fixing said holding members in set positions relative to one another.

10 Claims, 4 Drawing Sheets

HOLDING DEVICE

BACKGROUND TO THE INVENTION

1. Field of the Invention

This invention relates to a device for holding two rotary elements, disposed alongside one another, stationary relative to one another.

The invention has been devised for the purpose of holding stationary relative to one another the camshafts of a double overhead camshaft internal combustion engine, such camshafts being driven in timed relation to the engine crankshaft by a toothed drive belt (timing belt) entrained around toothed pulleys or sprockets (herein called sprockets) on the shafts. With the aim of preventing failure in service and possible consequential engine damage, service schedules usually specify belt replacement at predetermined time and/or mileage intervals, and to ensure that the timing relationship between the cam shafts and the crankshaft of the engine is not lost the camshafts may have to be held against rotation relative to one another while the old belt is removed and a new one fitted. Other rotary elements driven by the timing belt may also have to be held against rotation during the replacement operation, for example if an engine is a compression-ignition engine and there is a fuel injection pump whose timed driving is effected by the belt.

Service tools for effecting such holding of the camshafts and/or other rotary elements of engines are available, but as supplied by motor manufacturers they are usually specifically designed for one engine or family of engines and are not usable for other engines. If a service establishment wishes to perform such work on many different engines but does not wish to keep a large number of special tools, there is a requirement for a more versatile holding device which is capable of being used on a wide range of engines. One problem in the design of such a more versatile holding device is that drive sprockets might be very close together, with very little space between them in which any part of a holding device can be disposed.

SUMMARY OF THE INVENTION

It is broadly the object of the present invention to provide a holding device in which the above requirement and problem are addressed.

According to the present invention, we provide a device for holding a rotaiy element stationary against rotation relative to another rotary element adjacent thereto, comprising first, second, third and fourth holding members engagable each with one or other of the rotary elements; connecting means connecting said holding members to one another and providing for adjustment of at least three of said holding members relative to one another; and means for fixing said holding members in set positions relative to one another.

Preferably all the holding members are adjustable relative to one another.

In a device according to the invention, the ability of the holding members to be adjusted relative to one another means that the device is usable in a number of different situations, i.e. in different engines.

Preferably each holding member is adapted to engage with the periphery of a sprocket, constituting a said rotary element, with which a timing belt cooperates. To this end each holding member preferably comprises a formation which cooperates with one or more teeth of a sprocket, e.g. a protuberance which is able to extend radially inwardly relative to the sprocket into the space between adjacent teeth.

In one of the embodiments described hereafter, each holding member further comprises an arcuate or generally arcuate wall portion which is able to lie against the crests of a number of teeth, with a protuberance extending radially inwardly from the wall portion and able to fit between two adjacent such teeth.

Preferably the holding members are arranged with the first and second holding members adjustable relative to one another in respect of their position and/or orientation and the third and fourth holding members adjustable relative to one another in respect of their position and/or orientation, the connecting means providing for adjustment of said first and second holding members together, in position and orientation, relative to said third and fourth holding members together.

The connecting means preferably comprises an elongate connecting member relative to which said first and second holding members are together movable angularly whilst said third and fourth holding members are together movable angularly and lengthwise thereof.

The means for fixing the holding members in set positions relative to the connecting means preferably comprises clamping means. Each clamping means may comprise a screw member having threaded engagement with a holding member and passing through an opening in the elongate connecting member, with the connecting member being arranged to be clamped between a head of the screw member and the holding member when the screw is tightened.

Each such screw member may effect clamping of both the first and second or the third and fourth holding members as the case may be together to the connecting means, or may clamp only one holding member relative to the connecting member while the respective associated holding member is separately clamped to the aforesaid holding member, e.g. by a further screw member.

In use, the first and second holding members may be engaged one with one sprocket and the other with the other sprocket, at adjacent peripheral regions thereof outwardly of the narrowest part of the space therebetween, whilst the third and fourth holding members are likewise engaged with the two sprockets, but outwardly of the space therebetween in the opposite direction. In this case the connecting member may extend generally chordally or tangentially of the two sprockets or one of them.

In another embodiment of the holding device described hereafter, the first and second holding members may be engaged in use with spaced parts of the periphery of one of the sprockets while the third and fourth holding members are engaged with spaced parts of the periphery of the other sprocket. Viewed parallel to the axes of rotation of the sprockets, the connecting member then extends generally transversely across the gap between the peripheries of the sprockets.

In either event, the arrangement of the holding members means that there need be nothing in the narrowest part of the space between the sprockets so that the device can be used if the sprockets are very close together or if there is an engine part between them, e.g. a casting rib. The connecting means can be arranged to be spaced from the plane of the end faces of the sprockets.

BRIEF DESCRIPTION OF THE INVENTION

The invention will now be described by way of example with reference to the accompanying drawings, of which:

DESCRIPTION OF PREFERRED EMBODIMENTS

Figure 1:
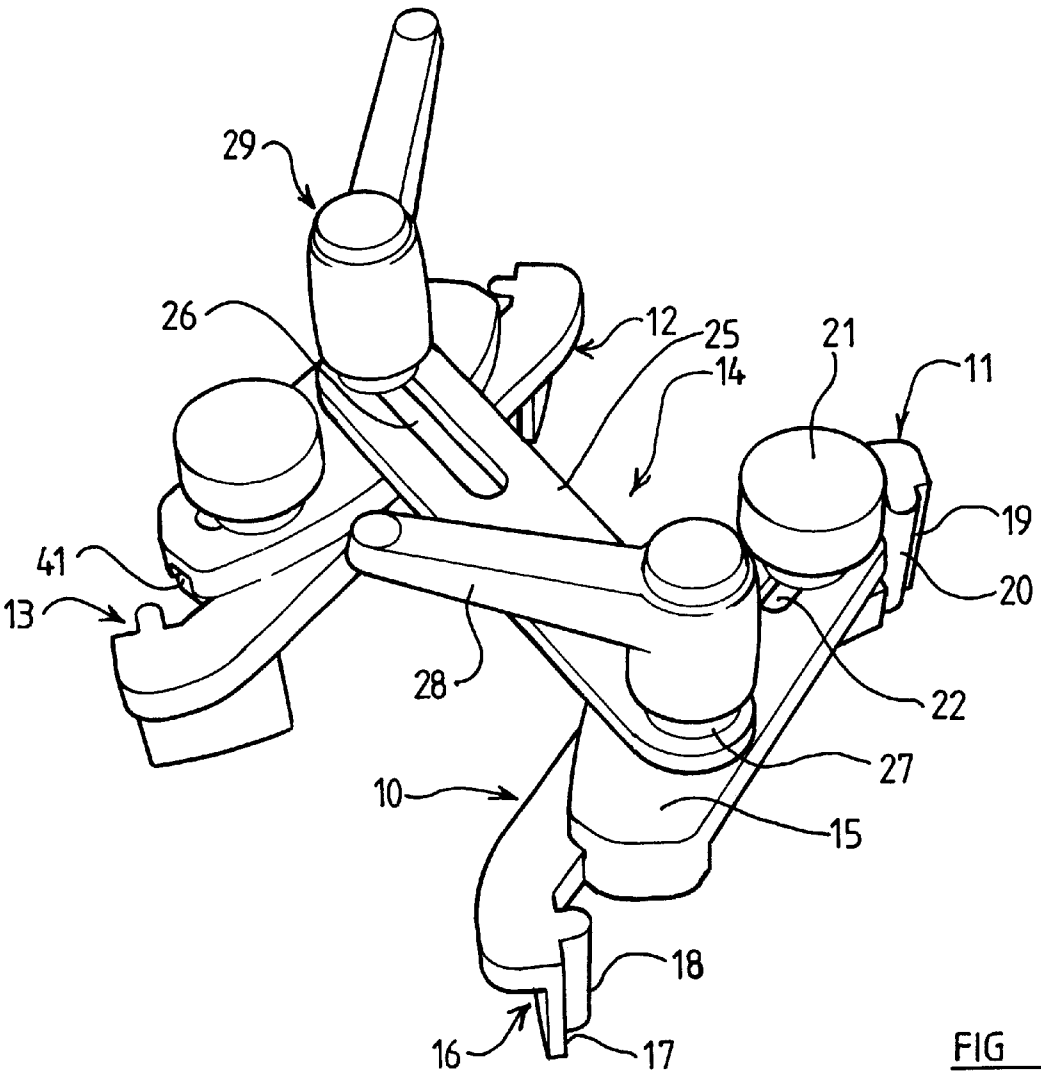
FIG. 1 is a perspective view of a first embodiment of holding device in accordance with the invention.

Referring firstly to FIG. 1 of the drawings, the holding device there illustrated comprises the principal components of four holding members 10, 11, 12, 13 and a connecting means 14. The holding members 10 and 12 are identical to one another, whilst the holding members 11 and 13 are also identical to one another.

The holding member 10 comprises a body 15 which is of elongate configuration and from the body 15 at one end thereof there extends an engagement portion indicated generally at 16. The engagement portion 16 comprises an arcuate wall formation 17 whose curvature is selected so as to be able to lie against the crests of several teeth of a typical camshaft-drive sprocket of an internal combustion engine.

Radially inwardly from the wall portion 17 there extends a protuberance 18, of a size able to engage between two such teeth.

At the opposite end of the body 15 from the engagement portion 16 of the first holding member 10, there is the second holding member 11. The second holding member 11 also comprises an arcuate wall portion 19 and a protuberance 20 extending inwardly therefrom. The holding member 11 is adjustable relative to the holding member 10, the body 15 having an arcuate recess beneath it in which a part of the holding member 11 engages so that the holding member 11 is movable in an arcuate path relative to the body 15. A clamping screw whose head is visible at 21 has a threaded shank which passes through a slot 22 in the body 15 and engages with a screw-threaded bore in the part of the holding member 11 which engages with the body 5. Thus the holding member 11 is able to be adjusted in respect of its position and orientation relative to the body 15, and when set in the required relative position is able to be clamped in such position by turning the screw head 21 to tighten the screw.

The holding members 12 and 13 are of the same configuration as the holding members 10 and 11, respectively, and are adjustable relative to one another in the same manner. The aforesaid arcuate recess beneath the body of the holding member 12 is indicated at 41.

The connecting means 14 comprises an elongate connecting member 25 having an elongate slot 26 towards one end. At its other end it has an aperture. It is connected to the body 15 of the holding member 10 by a clamping screw whose head is indicated at 27 and whose threaded shank passes through the aperture at the end of the connecting member 25 and engages with a screw-threaded bore in the body pair 15. The screw is able to be turned by a manually operable lever 28 which is able to be declutched from the head 27 of the screw by pulling the lever axially of the screw upwardly from the head. Such declutching action enables the screw to be tightened or loosened in increments of rotation if turning of the lever 28 through a complete revolution is not possible due to obstruction or lack of accessibility.

A further clamping means indicated generally at 29 and identical to that above described connects the body of the holding member 12 to the connecting member 25. In this case the shank of the screw passes through the slot 26 in the connecting member, with the result that the third and fourth holding members 12, 13 are able together to be moved towards and away from, and adjusted in their orientation relative to, the holdinig members 10, 11.

Figure 2:
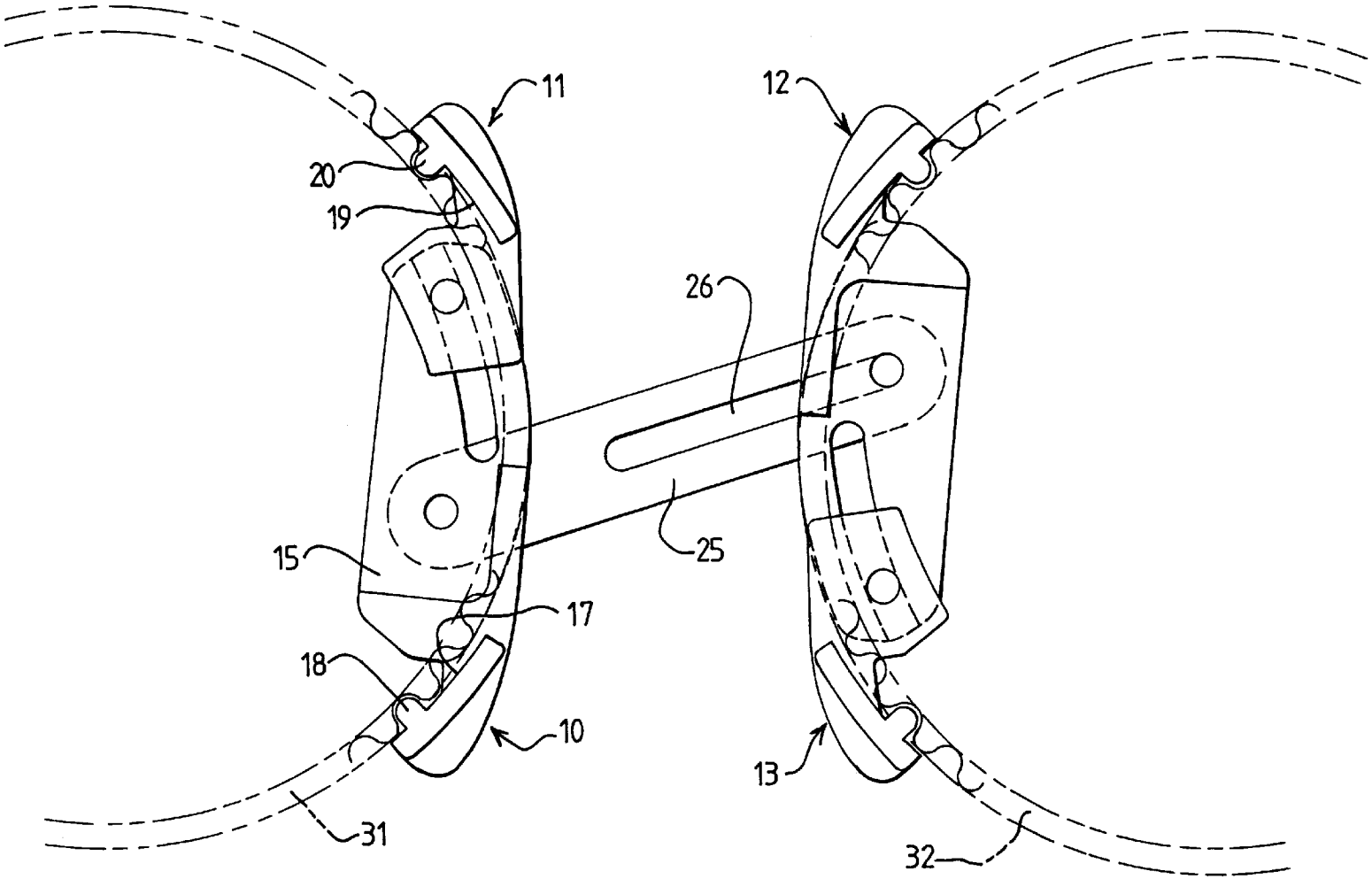
FIG. 2 shows, in an underneath view, the disposition of the device of FIG. 1 in use.

Use of the holding device as described in FIG. 1, to hold two sprockets 31, 32 stationary relative to one another, is, shown in FIG. 2. Engagement of the holding members 10, 11 with one of the sprockets and the holding members 12, 13 with the other sprocket is illustrated, and it will be appreciated that the above-described possibilities of relative adjustment between all the holding members enables sprockets of different sizes, different tooth spacings, and different spacings between their rotational axes, to be held. In particular, it will be noted that since each of the holding members only has a short length of arcuate wall portion which rests against the crest of only a small number of the sprocket's teeth, nothing has to be disposed in the narrowest gap part between closely-spaced sprockets so the device is usable with such sprockets. The connecting member 25 and the body 15 of the holding member 10 and the conesponding body part of the holding member 12 lie in front of the end faces of the sprockets.

Figure 3:
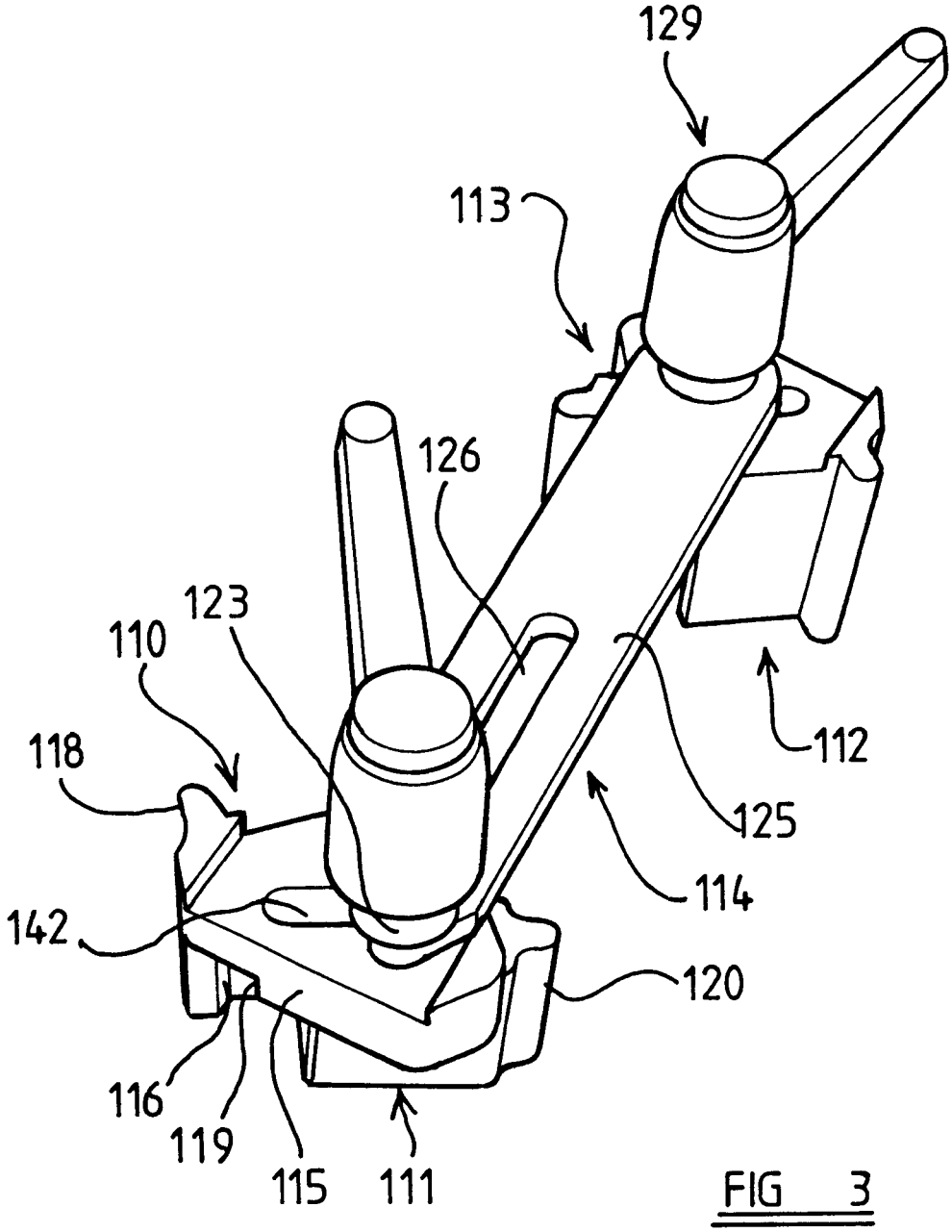
FIG. 3 is a perspective view of a second embodiment of holding device in accordance with the invention.
Figure 4:
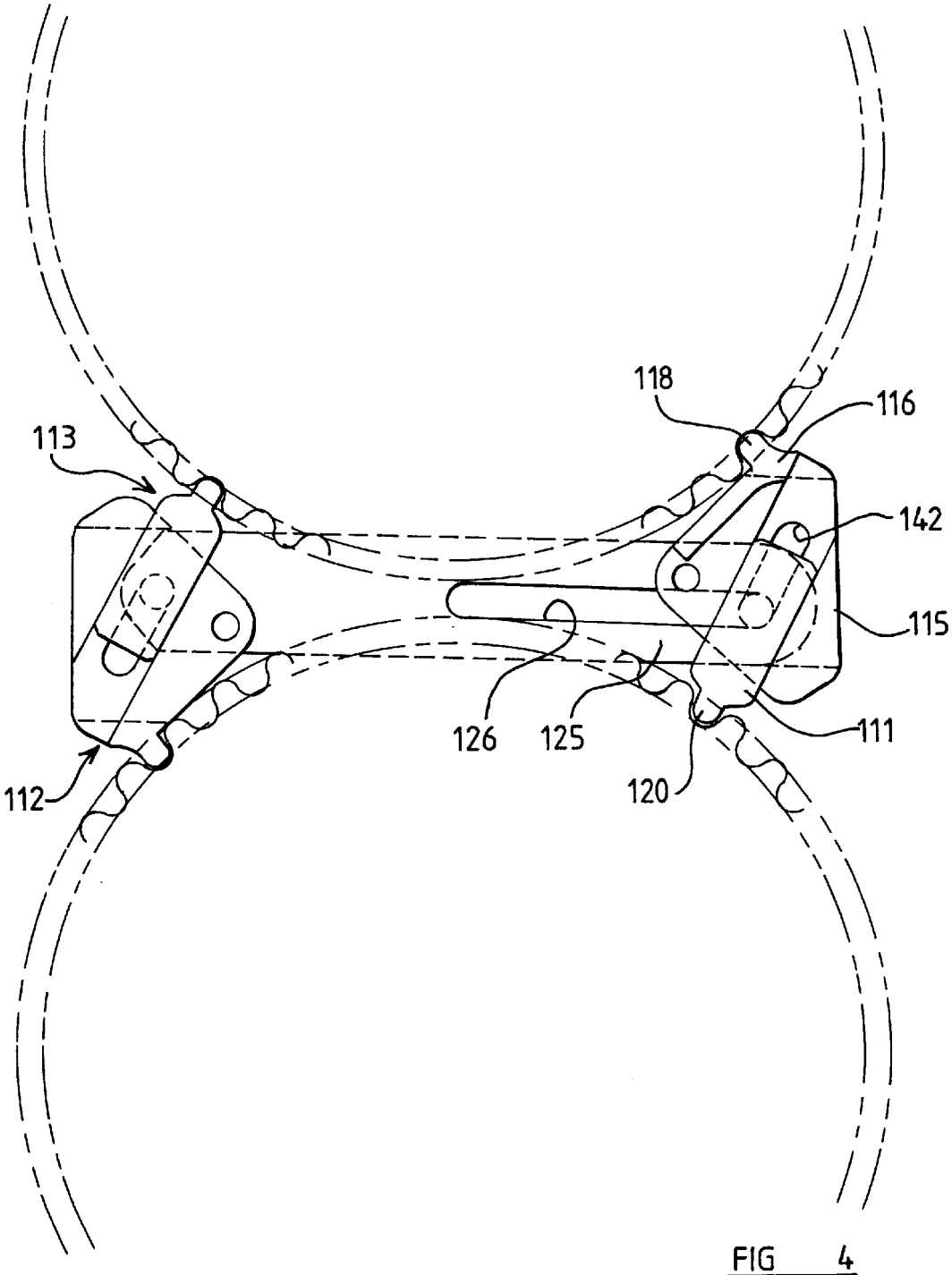
FIG. 4 shows the disposition of the device of FIG. 3 in use.

Referring now to FIGS. 3 and 4 of the drawings, these show a further embodiment of holding device in accordance with the invention. It comprises first, second, third and fourth holding members 110, 111, 112, 113 respectively, and a connecting means 114. The first holding member 110 has a body part 115, and an engaging part 116 including a formation 118 engagable between teeth on a timing belt sprocket.

The second holding member 111 engages and is slidable lengthwise of a groove 119 beneath the body part 115 of the first holding member 110, and at its end the second holding member 111 has a protuberant formation 120 for engaging between adjacent teeth on a timing belt sprocket. The third and fourth holding members are the same configuration as the first and second holding members respectively.

The connecting means 114 comprises an elongate strip of material 125 with an aperture adjacent one end and a longitudinally extending slot 126 at its other end. A clamping screw assembly with head 127 has its shank passing through the slot 126 and engaging with a screw-threaded bore in the second holding member 111, the shank passing through a slot 142 in the body part 115 between the second holding member 111 and the underside of the connecting member 125. The slot 142 is in line with the groove 119 with which the holding member 111 engages. Thus the first and second holding members are positionally adjustable relative to one another and adjustable in position and orientation relative to the connecting member 125, and the clamping screw (which is of the type above described) serves to clamp all these components in a position in which they are set relative to one another.

At the opposite end of the connecting member 125 a further clamping screw assembly indicated generally at 129 serves to clamp the third and fourth holding members 112, 113 in a position in which they are set relative to one another and these two holding members together in a required orientation relative to the connecting member 125. Thus in this embodiment also all the four holding members are adjustable relative to one another and are able to be held in a required position in which they are set.

In use of the device as shown in FIG. 3, such use being illustrated in FIG. 4, the first and second holding members are engaged one with the teeth of one sprocket and the other with the teeth of the other sprocket, at adjacent peripheral regions thereof outwardly of the narrowest part of the space between. The third and fourth holding members are likewise engaged with the respective sprockets, to the opposite side of the narrowest space therebetween. The connecting member extends chordally or tangentially relative to one or both sprockets, and is clear of the sprockets, lying in a plane parallel to the end faces thereof.

Thus both embodiments of the holding device according to the invention are extremely versatile, being capable of being used with sprockets of different sizes and spacing therebetween. Although in the described embodiments all the holding members are adjustable relative to one another, it is possible that a device of great versatility could be provided if only three of the holding elements were to be thus adjustable, with the fourth fixed relative to one of the other holding elements.

In the present specification "comprise" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A device adapted for holding a rotary element stationary relative to another rotary element adjacent thereto, comprising:

a first holding member engageable with one of the rotary elements;

a second holding member engageable with one of the rotary elements;

a third holding member engageable with one of the rotary elements;

a fourth holding member engageable with one of the rotary elements; and structure connecting said holding members together and providing for adjustment of at least three of said holding members relatively to one another, and for fixing said holding members in set positions relative to one another, said connecting structure including a connecting member, a first clamp releasably securing said first holding member to said connecting member in at least one of a selected orientation and a selected position relative to said connecting member, a second clamp releasably securing said second holding member to said first holding member in at least one of a selected orientation and a selected position relative to said first holding member, a third clamp releasably securing said third holding member to said connecting member in at least one of a selected orientation and a selected position relative to said connecting member, and a fourth clamp releasably securing said fourth holding member to said third holding member in at least one of a selected orientation and a selected position relative to said third holding member.

2. A device according to claim 1 wherein each holding member is adapted for engagement with the periphery of a timing belt sprocket constituting a rotary element.

3. A device according to claim 2 wherein each holding member comprises a formation adapted to extend inwardly of a sprocket between teeth thereof.

4. A device according to claim 3 wherein each holding member further comprises a generally arcuate wall portion adapted to lie against tooth crests of a sprocket.

5. A device according to claim 1 wherein said first and second holding members are adjustable to one another in respect of both their positions and orientation, and said third and forth holding members are adjustable relative to one another in respect of both their positions and orientation.

6. A device adapted for holding a rotary element stationary relative to another rotary element adjacent thereto, comprising:

a first holding member engageable with one of the rotary elements;

a second holding member engageable with one of the rotary elements;

a third holding member engageable with one of the rotary elements;

a fourth holding member engageable with one of the rotary elements;

structure connecting said holding members together and providing for adjustment of at least three of said holding members relatively to one another, and for fixing said holding members in set positions relative to one another, said first and second holding members being adjustable to one another in respect of at least one of their positions and orientation; said third and forth holding members being adjustable relative to one another in respect of at least one of their positions and orientation; said first and second holding members being adjustable together, in respect of their position and orientation, relative to said third and fourth holding members together, an elongate connecting member, and wherein said structure connecting said holding members includes a connection providing for angular movement of said first and second holding members together relative to said connecting member, and a connection providing for movement of said third and fourth holding members together angularly relative to said connecting member and lengthwise thereof.

7. A device according to claim 6 including clamping devices for fixing said holding members in set positions relative to said connecting member.

8. A device according to claim 7 wherein the clamping devices comprise respective screw members each having a manually engageable head and a shank which passes through an opening in said connecting member and has threaded engagement with a holding member.

9. A device according to claim 8 wherein one of said screw members engages said first and second holding members for fixing them relative to one another and to said connecting member, and a further said screw member engages said third and fourth holding members for fixing them relative to one another and to said connecting member.

10. A device according to claim 8 wherein one of said screw members engages said first and second holding members to hold it relative to said connecting member, a furrter said screw member engages one of said third and fourth holding members to hold it relative to said connecting member, a third said screw member engages said first and second holding members for holding them fixed relative to one another, and a fourth said screw member engages said third and fourth holding members for fixing them relative to one another.

* * * * *